US007312589B2

(12) United States Patent
Liu et al.

(10) Patent No.: US 7,312,589 B2
(45) Date of Patent: Dec. 25, 2007

(54) DRIVER CONTROL CIRCUIT AND METHOD FOR COLD CATHODE FLUORESCENT LAMP

(75) Inventors: Yuan-Ho Liu, Fengyuan (TW); Chun-Hsiung Chen, Hsinchu (TW)

(73) Assignee: Holtek Semiconductor, Hsinchu (TW)

( * ) Notice: Subject to any disclaimer, the term of this patent is extended or adjusted under 35 U.S.C. 154(b) by 0 days.

(21) Appl. No.: 11/338,793

(22) Filed: Jan. 25, 2006

(65) Prior Publication Data

US 2007/0126375 A1 Jun. 7, 2007

(30) Foreign Application Priority Data

Dec. 1, 2005 (TW) ..... 94142279 A

(51) Int. Cl.
*G05F 1/00* (2006.01)

(52) U.S. Cl. ..... 315/308; 315/307

(58) Field of Classification Search ..... 315/307, 315/291, 209 R, 157, 159, 246, 293, 308
See application file for complete search history.

(56) References Cited

U.S. PATENT DOCUMENTS 5,930,121 A * 7/1999 Henry ..... 363/16
6,501,234 B2 * 12/2002 Lin et al. ..... 315/307
6,707,264 B2 * 3/2004 Lin et al. ..... 315/307
6,853,153 B2 * 2/2005 Gray ..... 315/291
6,927,989 B2 * 8/2005 Fukumoto ..... 363/95
6,930,898 B2 * 8/2005 Jeon et al. ..... 363/98
6,982,889 B2 * 1/2006 Fukumoto ..... 363/98
6,999,328 B2 * 2/2006 Lin ..... 363/71
7,095,632 B2 * 8/2006 Fukumoto ..... 363/17
7,095,635 B2 * 8/2006 Fukumoto ..... 363/21.09

* cited by examiner

*Primary Examiner*—Shih-Chao Chen
*Assistant Examiner*—Minh Dieu A
(74) *Attorney, Agent, or Firm*—Troxell Law Office, PLLC

(57) ABSTRACT

A driver control circuit and method for a cold cathode fluorescent lamp (CCFL), that the driver control circuit comprises: at least a comparator; at least an input/output port, at least an analog-to-digital converter; at least two programmable pulse generators (PPGs), including a first programmable pulse generator and a second programmable pulse generator, i.e. PPG0 and PPG1, being activated for generating pulse signals in an alternative manner for driving the CCFL; at least a programmable frequency divider (PFD), capable of programming the output thereof to be used as the control signal for activating the PPG0 and the PPG1 according to the alternative manner defined by the transition frequency of the PFD.

10 Claims, 3 Drawing Sheets

DRIVER CONTROL CIRCUIT AND METHOD FOR COLD CATHODE FLUORESCENT LAMP

FIELD OF THE INVENTION

The present invention relates to a driver control circuit and method for a cold cathode fluorescent lamp (CCFL), and more particularly, to a driver control circuit for a CCFL capable of using a software-controlled programmable frequency divider (PFD) to issue a signal for controlling two programmable pulse generator (PPGs) to be activated in an alternative manner, that is, the transition frequency of the PFD can be programmed and used to activate the two PPGs alternatively with respect to each transition of frequency thereof.

BACKGROUND OF THE INVENTION

It is known that the discharge lamps, such as cold cathode fluorescent lamp (CCFL), are often being used as the backlight of liquid crystal displays. The cold cathode fluorescent lamps are generally driven by alternating current (AC) with frequency matching the specification of the CCFLs.

To ignite or first turn on a CCFL, the circuit for driving the CCFL must provide a momentary strike or startup voltage that is typically more than 1000 V and is usually referred as the discharge voltage, starting voltage or striking voltage. After switching to normal running, the operating voltage of the CCFL is generally in a range from 300V to 700V, that is about one half or one third the starting voltage, depending on the type of the CCFL. When current flows though the tube, the impedance of the tube decreases and the voltage across the tube drops rapidly. When current flows to a particular level, the decline of tube voltage stops and the CCFL shows an almost steady voltage, the voltage at this time is called tube voltage, operating voltage or running voltage. It is necessary to keep the current flowing after startup. The tube current is directly proportional to the CCFL brightness, increasing the CCFL current increases the brightness, however too much current may damage the electrode and lead to a shorter lifetime. Generally, 3 mA to 7 mA is commonly used for each CCFL. CCFLs are generally driven by alternating current (AC), the AC frequency typically ranges from 30 kHz to 100 kHz.

The CCFLs are typically driven by a DC to AC inverter, which generally provides a wide range of DC input voltage and transforms the voltage into an AC high voltage and high frequency output to run the lamp. However, CCFLs exhibit a negative impedance characteristic which makes the series resistance measured in the CCFL tube to decrease rather than to increase as desired when the current flowing therein is increased. Therefore, The inverter used for driving CCFLs must be able to provide an adjustable AC power and a feedback circuit for ensuring the stability of the driving circuit of CCFLs while allowing the loading of CCFLs to be adjusted.

Conventionally, the brightness of a CCFL is controlled by a power driving means that is integrated in an application specific integrated circuit (ASIC). However, since CCFLs of different tube size will require to be driven by different driving frequency, there should be as many ASICs specifically designed to meet the requirement of those CCFLs. That is, there is a specifically designed ASIC for a specific CCFL, that is not economically sound with respect to modern industrial standard. Therefore, it is in need of a micro control unit (MCU) which can be programmed and adapted for controlling CCFLs of different specifications. It is not only intended to control various CCFLs by using a same MCU, but also to save the manufacturing cost of CCFLs accordingly.

SUMMARY OF THE INVENTION

In view of the disadvantages of prior art, the primary object of the present invention is to provide a micro control unit (MCU) for controlling the driver circuit of a CCFL, which is comprised of: an input/output (I/O) port; an analog-to-digital converter (ADC); a programmable frequency divider (PFD); and two programmable pulse generators (PPGs); wherein the PFD is controlled by a software to issue a signal for controlling the two PPGs to be activated in an alternative manner, that is, the transition frequency of the PFD can be programmed by the software and to be used for activating the two PPGs alternatively with respect to each transition of frequency thereof.

It is another object of the invention to provide an analog-to-digital converter (ADC), which is adapted to be used in a driver circuit of a CCFL for current and voltage detection and thus enables the driver circuit to control the power of the CCFL.

It is yet another object of the invention to provide a more versatile and flexible method for driving various CCFLs, which is realized by using a software to control an internal timer of a MCU for enabling a PDF to generate outputs of variable frequency while controlling the modulation of the output pulse width of the PFD by the internal timer and a prescaler with respect to the instructions of the software.

To achieve the above objects, the present invention provide a driver control method for a cold cathode fluorescent lamp (CCFL), being realized in a circuit configuration comprising a micro control unit, a plurality of I/O ports, a plurality of analog-to-digital converter (ADCs), a comparator, a programmable frequency divider (PFD) and two programmable pulse generators (PPGs), i.e. a PPG0 and a PPG1, the method comprising the steps of:

programming the output of the PFD to be used as the control signal for activating the PPG0 and the PPG1;

utilizing a software to modify the PFD clock source emanated form a timer for enabling the PFD to output a frequency matching the tube frequency of the CCFL; and utilizing the transition frequency of the PFD to control the activation of the PPG0 and the PPG1 in an alternative manner.

To achieve the above objects, the present invention provides a driver control circuit for a CCFL, comprising:

at least a comparator;

at least an input/output (I/O) port;

at least an analog-to-digital converter (ADC);

at least two programmable pulse generators (PPGs), including a PPG0 and a PPG1, being activated for generating pulse signals in an alternative manner for driving the CCFL; and at least a programmable frequency divider, capable of programming the output thereof to be used as the control signal for activating the PPG0 and the PPG1 according to the alternative manner defined by the transition frequency of the PFD.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 1:
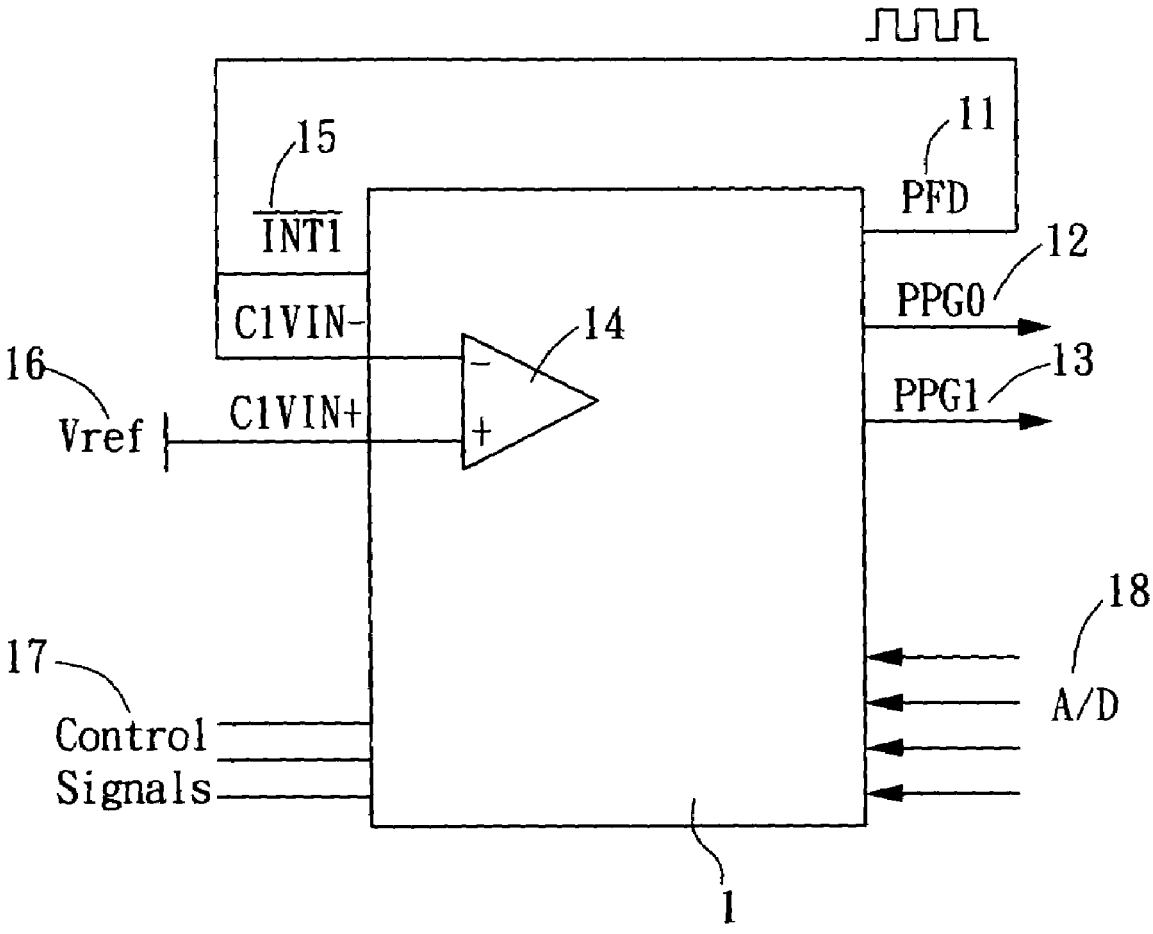
FIG. 1 is a schematic view of a micro control unit according to the present invention.
Figure 3:
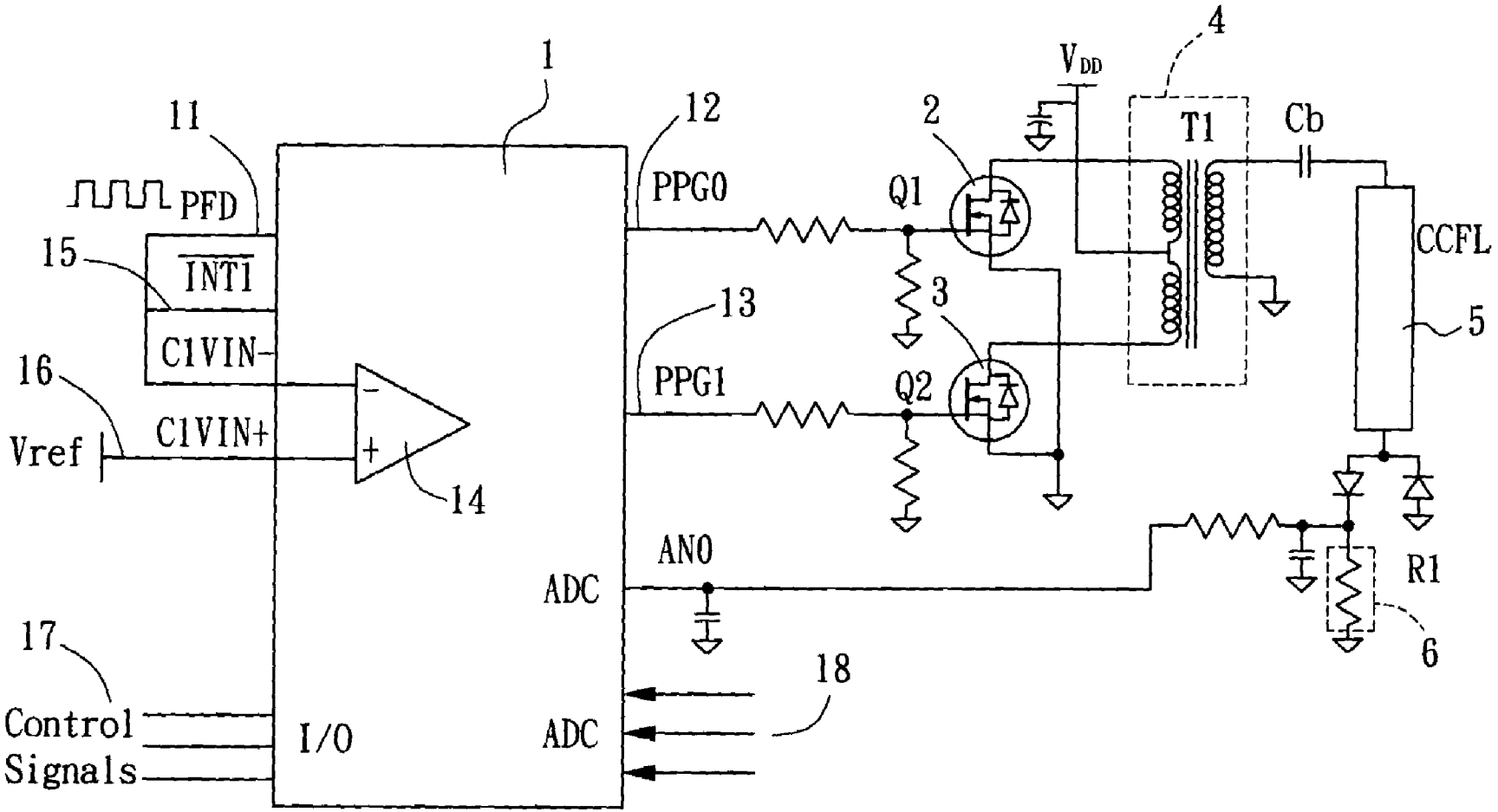
FIG. 3 is a schematic view of a driver circuit for a CCFL.

Please refer to FIG. 1 and FIG. 3, which are respectively a schematic view of a micro control unit according to the present invention and a schematic view of a driver circuit for a CCFL. As seen in FIG. 1, the micro control unit (MCU) is comprised of: a plurality of I/O ports, a plurality of analog-to-digital converter (ADCs) 18, a comparator 14, a programmable frequency divider (PFD) 11 and two programmable pulse generators (PPGs), i.e. a PPG0 12 and a PPG1 13. As the MCU of FIG. 1 is fitted in a driver control circuit for a cold cathode fluorescent lamp (CCFL) as seen in FIG. 3, the PPG0 12 and the PPG1 13 are respectively being connected to a first tube driving unit 2 and a second tube driving unit 3. In the preferred embodiment of the invention shown in FIG. 3, both the two tube driving unit 2, 3 are Metal Oxide Semiconductor Field Effect Transistors (MOSFETs). However, it is known to those skilled in the art that the tube driving unit used in the invention also can an Insulated Gate Bipolar Transistor (IGBT) or a Bipolar Junction Transistor (BJT). In FIG. 3, the first tube driving unit 2 and the second tube driving unit 3 are further connected to the input of a voltage booster 4 while the output thereof is connected to a CCFL 5 connecting to a resistor 6, referred as R1. Therefore, the circuit of FIG. 3 is a direct drive with a push-pull configuration. Moreover, the voltage booster 4 can be a transformer booster such as a high frequency transformer. That is, The PPG0 and PPG1 outputs are connected to both the Q1 and Q2 MOSFETs 2, 3 that are comprised of a push-pull structure in the primary side of the 10 transformer while PPG0 and PPG1 are used to turn on Q1 and Q2 alternately.

The comparator 14 is used as the PPG0 start control signal. When comparator 14 is enabled, it will output a falling edge signal to start the PPG0 12 output until the PPG0 timer overflows, which will then stop the PPG0 12 output. It is noted that a software is adopted for controlling the output duration of the PPG0 12 through the control of a first timer and a first prescaler in a manner that the output of the PPG0 12 is stopped as soon as the overflow of the first timer.

INT1 15 is used as the PPG1 13 start control signal, triggered by a falling edge signal. The PPG1 13 control method is the same as for PPG0 12, whereas the software is also being adopted for controlling the output duration of the PPG1 13 through the control of a second timer and a second prescaler in a manner that the output of the PPG1 13 is stopped as soon as the overflow of the second timer.

When the PFD 11 outputs a signal that changes from low to high and the level is higher than a reference voltage 16, i.e. a Vref, the comparator 14 outputs a falling edge to start the PPG0 12 output counting. Similarly, when the PFD output signal changes from high to low, the PPG1 output will start counting as the INT1 15 triggers a falling edge signal. Accordingly, a user can regulate the PPG0 12 and the PPG 1 13 to be activated in an alternative manner. In addition, it is known to those skilled in the art that, by parallel-connecting the output signal lines of the PPG0 12 and the PPG1 13, a plural sets of PPGs can be activated by the abovementioned configuration.

The values of the PPG timers and prescalers can be controlled by a software during the PFD output period to control the PPG pulse width and thus control the duty of pulse width modulation (PWM) of the PPGs, that is, the PPG output pulse width should be controlled to be less than every high period or low period of the PFD. Moreover, as seen in FIG. 3, the CCFL 5 is serially connected to the resistor 6, i.e. R1, for using the being R1 as a potentiometer to detect the current of the CCFL 5 for controlling the brightness thereof.

By the aforementioned circuit configuration composed of a micro control unit (MCU), a plurality of I/O ports, a plurality of analog-to-digital converter (ADCs) 18, a comparator 14, a programmable frequency divider (PFD) 11 and two programmable pulse generators (PPGs), i.e. a PPG0 12 and a PPG1 13, a driver control method for CCFLs can be provided, whereas each ADC 18 is capable of detecting current and voltage and thus enables the circuit configuration to control the power of the CCFL 5. The driver control method comprises the steps of:

- programming the output of the PFD to be used as the control signal for activating the PPG0 12 and the PPG1 13 for generating pulse signals in an alternative manner for driving the CCFL 5; wherein a first software is used for controlling the output duration of the PPG0 12 through the control of a first timer and a first prescaler in a manner that the output of the PPG0 12 is stopped as soon as the overflow of the first timer, and a second software is also used for controlling the output duration of the PPG1 13 through the control of a second timer and a second prescaler in a manner that the output of the PPG1 13 is stopped as soon as the overflow of the second timer;
- utilizing a third software to modify the PFD clock source emanated form a timer for enabling the PFD to output a frequency matching the tube frequency of the CCFL;
- utilizing the transition frequency of the PFD to control the activation of the PPG0 12 and the PPG1 13 in an alternative manner;
- enabling each ADC 18 to be used as a means of current and voltage detection of the CCFL 5 for enabling the circuit configuration to control the power of the CCFL 5.

Figure 2:
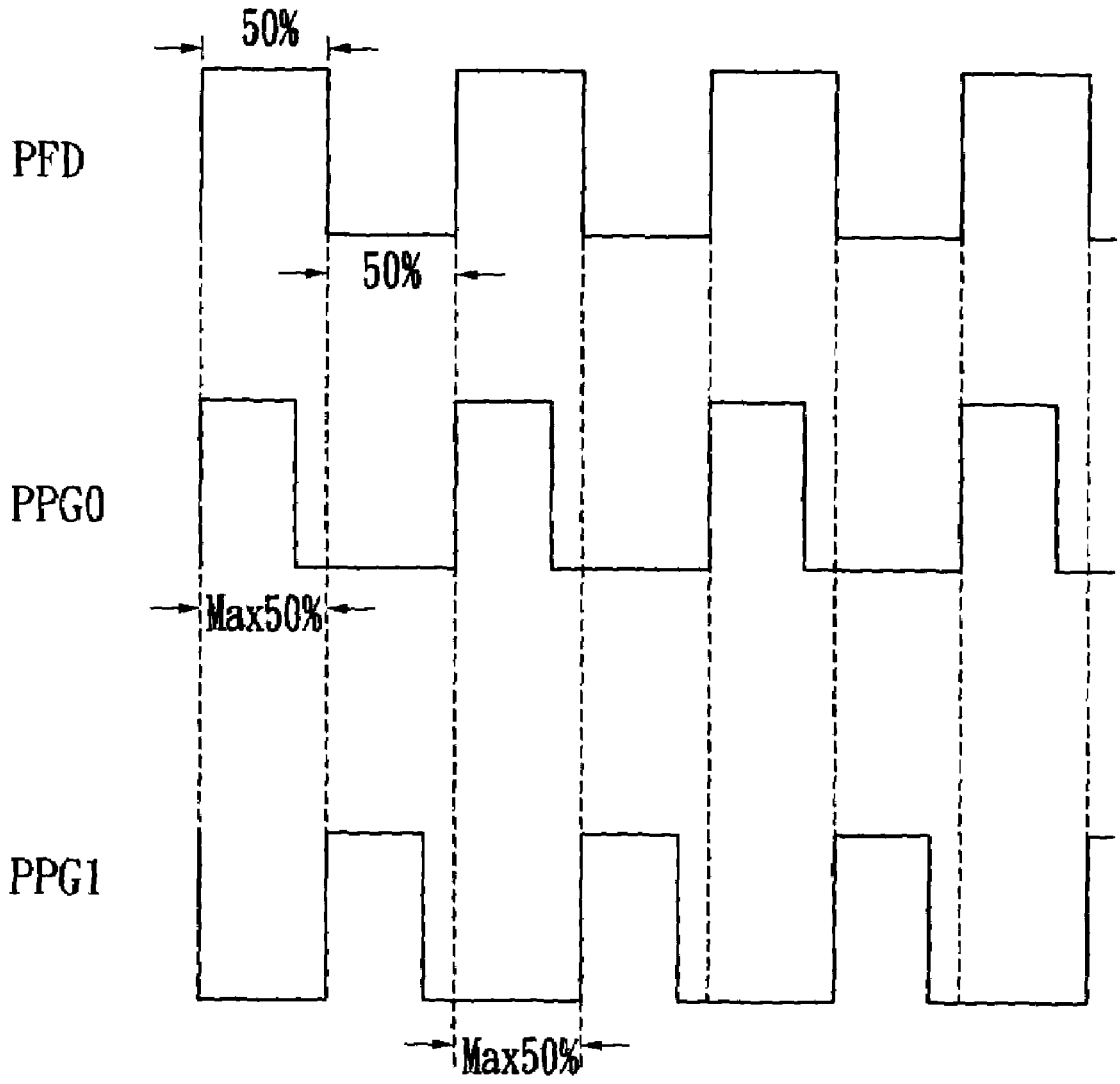
FIG. 2 is a schematic diagram illustrating the waveforms outputted by the PFD-controlled PPG0 and PPG1 according to the present invention.

Please refer to FIG. 2, which is schematic diagram illustrating the waveforms outputted by the PFD-controlled PPG0 and PPG1 according to the present invention. The user can enable the PFD 11 output using software instructions to generate a fixed 50% duty cycle signal with its frequency being controlled by the timer overflows of the MCU 1 in the foregoing circuit configuration. In this way, not only the PFD 11 can be enabled to output a specific frequency as required, but also both the PPG0 and PPG1 can be enabled to generated pulse width modulation (PWM) of variable duty cycle.

To sum up, the primary object of the present invention is to provide a micro control unit.(MCU) for controlling the driver circuit of a CCFL, which is comprised of: an input/output (I/O) port; an analog-to-digital converter (ADC); a programmable frequency divider (PFD); and two programmable pulse generators (PPGs); wherein the PFD is controlled by a software to issue a signal for controlling the two PPGs to be activated in an alternative manner, that is, the transition frequency of the PFD can be programmed by the software and to be used for activating the two PPGs alternatively with respect to each transition of frequency thereof.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A driver control method for controlling a variety of cold cathode fluorescent lamps (CCFLs), each CCFL having a different frequency requirement, being realized in a circuit configuration comprising a micro control unit, a plurality of input/output ports, a plurality of analog-to-digital converter, a comparator, a programmable frequency divider (PFD) and two programmable pulse generators (PPGs), comprising a PPG0 and a PPG1, the method comprising the steps of:

programming the output of the PFD to be used as the control signal for activating the PPG0 and the PPG1;

utilizing control software to modify a clock source received by the PFD for enabling the PFD to selectively output a frequency matching the differing tube frequency requirement of each CCFL; and utilizing the transition frequency of the PFD to control the activation of the PPG0 and the PPG1 in an alternative manner.

2. The method of claim 1, wherein the software is capable of controlling the output duration of the PPG0 through the control of a first timer and a first prescaler in a manner that the output of the PPG0 is stopped as soon as the overflow of the first timer.

3. The method of claim 1, wherein the software is capable of controlling the output duration of the PPG1 through the control of a second timer and a second prescaler in a manner that the output of the PPG1 is stopped as soon as the overflow of the second timer.

4. The method of claim 1, wherein each analog-to-digital converter in the circuit configuration for driving the CCFL is capable of detecting current and voltage and thus enables the circuit configuration to control the power of the CCFL.

5. A driver control circuit for controlling a variety of cold cathode fluorescent lamps (CCFLs), each CCFL having a different frequency requirement, comprising:

at least a comparator;

at least an input/output port;

at least an analog-to-digital converter;

at least two programmable pulse generators (PPGs), including a PPG0 and a PPG1, being activated for generating pulse signals in an alternative manner for driving the CCFL; and at least a programmable frequency divider (PFD), capable of programming the output thereof to selectively match the frequency requirement of the CCFL of the variety of CCFLs, the PFD being configured to selectively provide a control signal for activating the PPG0 and the PPG1 according to the alternative manner defined by the transition frequency of the PFD.

6. The circuit of claim 5, wherein the PPG0 is connected to a tube driving unit while the PPG1 is connected to another tube driving unit.

7. The circuit of claim 6, wherein the tube driving unit is a device selected from the group consisting of a Metal Oxide Semiconductor Field Effect Transistor (MOSFET) and a Bipolar Junction Transistor (BJT).

8. The circuit of claim 5, wherein the PPG0 and the PPG1 are connected to a voltage booster for boosting voltage to the operating voltage of the CCFL.

9. The circuit of claim 8, wherein the voltage booster is a transformer booster.

10. The circuit of claim 5, wherein the CCFL is serially connected to a resistor, being used as a potentiometer to detect the CCFL current for controlling the brightness thereof.

* * * * *